United States Patent [19]

Dillard et al.

[11] Patent Number: 4,815,386

[45] Date of Patent: Mar. 28, 1989

[54] PYROPHORIC MATERIAL WITH METAL SKELETON

[75] Inventors: David P. Dillard, New Castle, Del.; Alfonso L. Baldi, Wynnewood, Pa.

[73] Assignee: Alloy Surfaces Company, Inc., Wilmington, Del.

[21] Appl. No.: 643,782

[22] Filed: Jul. 17, 1984

[51] Int. Cl.[4] ..... F42B 11/24

[52] U.S. Cl. ..... 102/364; 149/2; 149/5; 149/6; 149/15; 428/550; 428/558

[58] Field of Search ..... 149/5, 6, 15, 2; 102/364; 428/550, 558

[56] References Cited

U.S. PATENT DOCUMENTS

| | | | |
|---|---|---|---|
| 3,946,673 | 3/1976 | Hayes | 102/364 |
| 4,089,715 | 5/1978 | Scherzinger | 149/6 |
| 4,096,804 | 6/1978 | Bilsbury | 102/364 |
| 4,131,498 | 12/1978 | Lucy | 149/2 |
| 4,349,612 | 9/1982 | Baldi | 428/607 |
| 4,351,239 | 9/1982 | McCubbin et al. | 102/364 |
| 4,432,818 | 2/1984 | Givins | 149/22 |
| 4,435,481 | 3/1984 | Baldi | 149/15 |
| 4,708,913 | 11/1987 | Baldi | 428/607 |

*Primary Examiner*—Edward A. Miller

*Attorney, Agent, or Firm*—Connolly and Hutz

[57] ABSTRACT

Pyrophoric preparations made of crushable open-celled metal skeleton such as honeycomb, metal foam or expanded twisted foil, filled with pyrophoric powder, so that when crushed to make a compact disc the metal skeleton is deformed and helps lock the powder particles in place.

7 Claims, 1 Drawing Sheet

PYROPHORIC MATERIAL WITH METAL SKELETON

The present invention relates to pyrophoric preparations, and particularly to such preparations in which the pyrophoric character is contributed by pyrophoric powder.

Among the objects of the present invention is the provision of novel pyrophoric preparations.

The foregoing as well as additional objects of the present invention will be more fully understood and appreciated from the following description of several of its exemplifications, reference being made to the accompanying drawings, wherein.

In the prior art, as described for instance in U.S. Pat. No. 3,068,157, it has been suggested to press or sinter a quantity of pyrophoric powder about a metal gauze to hold the powder together. It has also been suggested in U.S. patent application Ser. No. 559 334 filed Dec. 8, 1983 (subsequently abandoned) to hold such powder in plastic sponges.

According to the present invention a mass of pyrophoric powder is held in a crushable open-celled metal skeleton in which the wall thickness of the metal is not over about 3 mils thick. Such a skeleton can take different forms, as for instance a metal honeycomb, a metal foam and an expanded twisted metal foil. When such a crushable skeleton containing pyrophoric powder is crushed, the and locks in the powder to thus hold it in place. Discs or the like of such a crushed compact can thus be made with thicknesses ranging from as little as 1/10 millimeter to as much as two or more millimeters. For many pyrophoric purposes thicknesses of about ¼ to about 1 millimeter are particularly desirable.

The open cells of the skeleton, before crushing, should be at least about 1/10 millimeter in size, and can be as large as about 4 millimeters in size. Preferred sizes are between about 1 and about 3 millimeters. The metal of the skeleton is preferably combustible, and aluminum and iron are preferred.

Figure 1:
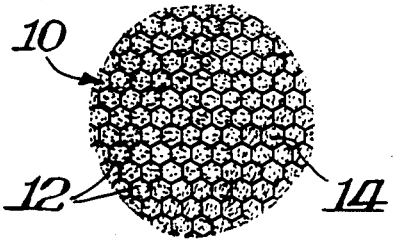
FIG. 1 is a plan view of a pyrophoric preparation representative of the present invention.

Turning now to the drawings, FIG. 1 shows a short honeycomb 10 made of strips of 1 mil thick aluminum foil 12 spot cemented or welded to each other, with its honeycomb cells about ⅛ inch wide filled with pyrophoric iron powder 14. Such powder is available commercially, and it can also be prepared by the techniques described in U.S. patent applications Ser. No. 281,405 filed July 8, 1981, now U.S. Pat. No. 4,708,913 granted Nov. 24, 1987 and Ser. No. 538,531 filed Oct. 3, 1983. The powder filling can be to a height somewhat above the height of the honeycomb walls, particularly if the filling is loose and the powder compresses to less than 80% of its bulk volume. Otherwise the filling can be up to the height of the honeycomb, or even 5 to 10% less than that height, so that the be partially crushed.

Sometimes honeycomb suppliers refuse to deliver honeycombs that are about 1½ millimeters in height or smaller. In that event taller honeycombs can be obtained and cut transversely to the desired height. Where the metal walls of the honeycomb are not too stiff, the honeycomb can have its walls flattened against each other so that its cells are completely collapsed and the flattened assembly is essentially a collection of foils. Such a flattened assembly is very effectively cut to any desired height, as small as ½ millimeter if desired, using a good quality paper cutter. This is particularly effective when the honeycomb walls are hard or soft aluminum about 1 mil thick or thinner. The cut-off assembly is then pulled out to return it to its honeycomb shape.

Figure 2:
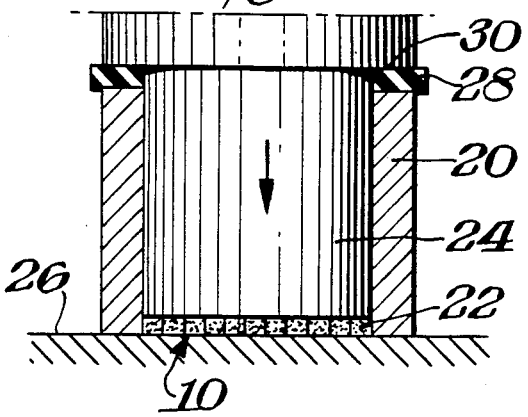
FIG. 2 is a vertical sectional view showing the preparation of FIG. 1 in position to receive a crushing treatment.
Figure 3:
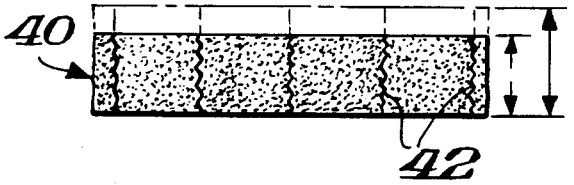
FIG. 3 shows the foregoing pyrophoric preparation after it has been subjected to the crushing treatment.

FIG. 2 illustrates a technique for compressing and crushing the powder-containing honeycomb. A heavy-walled cylindrical mold 20 has inserted in its lower mouth 22 a honeycomb about 1 millimeter high and cut to fit within that mouth. With the assembly held in an argon box, the honeycomb is then loaded with pyrophoric iron powder having particle sizes ranging from 1 to 10 microns. This is conveniently done by first inserting mold plunger 24 into the mold, turning the mold and plunger upside down so that the honeycomb is at the very top of the inverted mold, and pouring the pyrophoric powder into the honeycomb. A flat plate such as 26 is then placed over the top of the inverted powder-filled honeycomb and held in that position while the assembly is reinverted so that it is in the position shown in FIG. 2. The plunger 24 is then removed, a resilient rubber ring 28 slipped over the plunger and against a shoulder 30 extending out from it, and the ring-carrying plunger reinserted in the mold.

Where the mold has an internal diameter of about 3 centimeters, a force of 60 tons applied by the plunger against the filled honeycomb produces the final product which is shown in FIG. 3. The ring 28 causes the shoulder 30 of the plunger to press down against the mold so that during the compacting the bottom of the mold is pressed securely against plate 26 to prevent the escape of powder from the mold mouth 22 under the influence of the very large compacting force. The compacted filled honeycomb is then pushed out of the mold as by lifting the mold and pressing the plunger down a little further. It may be necessary to remove the ring 28 before the compact is pushed out, and such removal can be accomplished by first lifting the plunger out of the mold.

As shown in FIG. 3, the pyrophoric compact 40 thus formed has its honeycomb walls 42 at least partly crumpled and interlocked with the compacted powder in its cells, so that the compact is securely held together and difficult to break. It can accordingly be used for any pyrophoric purpose such as to have a number of the compacts projected into the air to burn and generate a hot cloud, as described in the above-cited patent applications.

Such burning causes the powder particles to expand in size so that they remain in place in the honeycomb. Where the burning is severe enough to cause the honeycomb metal to also burn, that metal can be completely burned away.

The pyrophoric action can be retarded or delayed by coating the compact with a slowly volatilized material such as a hydrocarbon or fluorocarbon liquid, or by impregnating it with colloidal particles as described in the above-cited applications.

On the other hand the pyrophoric action can be intensified as by coatings described in U.S. Pat. No. 4,349,612 that undergo exothermic reaction as a result of the pyrophoric action. In addition the honeycomb itself can be made of a metal such as iron that has been pre-treated to render it pyrophoric.

Figure 4:
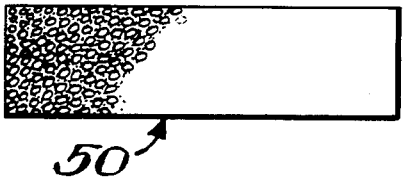
FIGS. 4 and 5 show different forms of cellular metal suitable for the pyrophoric preparations of the present invention.

FIG. 4 shows an open-celled metal foam 50 that can take the place of the honeycomb. It is preferred that the metal foam, before the pyrophoric particles are added to it, be sufficiently open-celled so that it shows a density not over ¼ the density of the metal itself. In other words the pores or voids occupy at least about three times the volume of the metal.

Instead of foaming the metal to produce the metal foam, it can be produced by plating metal on the surfaces of an open-celled foam of a plastic that can then be removed by burning or dissolution. This is set out in the following example.

EXAMPLE

A 29 by 29 inch sheet of open-celled resilient polyurethane foam ¼ inch thick having a density of about 5 pounds per cubic foot is prepared for metal plating by first cleaning it with acetone. The sheet is best squeezed to thoroughly work the acetone through it. The acetone-soaked foam is thoroughly rinsed with tap water and then immersed for three minutes in a cold aqueous solution of 55 grams $SnCl_2.2H_2O$ and 165 cc 20% HCl, made up to one liter with water. All bubbles are worked out of the immersed foam, and the solution kept below 100° F. at all times. The thus-treated foam is then rinsed thoroughly in cold water, and squeezed to remove excess rinsing water. It is then immersed in an aqueous solution of 0.25 gram $PdCl_2$ and 4.5 ml. 20% HCl, diluted to four liters with water. The resulting foam is then again rinsed in cold water, and immersed in an electroless copper plating bath. One such plating bath contains 15 grams $CuSO_4.5H_2O$, 30 grams potassium sodium tartrate and 14 grams NaOH dissolved in enough water to make one liter of solution, to which solution there is added just before use 10 ml. of 36% aqueous formaldehyde solution. After five minutes in such bath the treated foam, now lightly coated with copper, is rinsed in tap water to remove excess bath. The foam is thus ready to receive electroplatings of nickel, iron or copper for instance to build up the metal coating thickness to about one to two mils. A final tap water rinsing followed by burning in air leaves an open-celled very low density metal foam that readily receives and holds pyrophoric powder that has particles as large as ½ millimeter. To further assure the retention of such particles, the metal foam can be crushed down against the particles contained in it. Thus a pressing mold about one inch by two inches can be opened, a cut piece of the metal foam correspondingly dimensioned placed in it followed by about a ¼ inch thick loose layer of pyrophoric nickel or iron powder, and a die then inserted and pressed against the mold contents under a force of 200 pounds. Withdrawing the die leaves a disc about 2 millimeters thick of pyrophoric powder adherently held together by crumpled metal foam. The disc can be bent about 5 degrees away from its pressed plane without crumbling or losing a significant portion of the pyrophoric powder.

The plating can be as thin as 0.1 mil and as thick as two to three mils, and made of other metals preferably those that burn with significant heat generation. The metal foams can be made as thin as about ½ millimeter before pressing.

Figure 5:
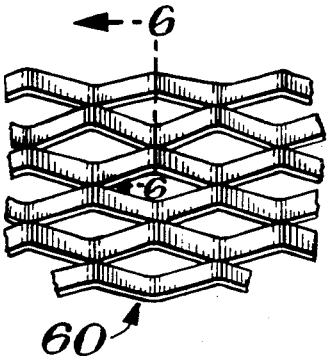
Figure 6:
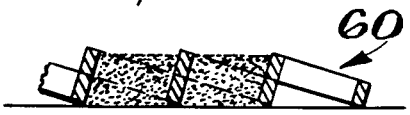
FIG. 6 is a sectional view of the cellular metal construction of FIG. 5.

FIGS. 5 and 6 show a powder-filled expanded metal skeleton 60 made from a thin metal foil that is slit in the expanded metal manner and then pulled apart at the slits while the foil segments are twisted up out of the plane of the original foil as more clearly illustrated in FIG. 6. This twisting permits the expanded skeleton to be crushed by compacting to lock in powder particles that have been previously poured over it. Such metal skeletons can have an overall thickness as small as about 1/6 millimeter, before crushing to yield final compacted discs of about the same or slightly smaller thickness.

A similarly crushable metal skeleton can be made by punching perforations in a metal foil and then corrugating the punched foil.

Powdered lithium is a particularly desirable additive to a pyrophoric compact, inasmuch as powdered lithium ignites in air at a very low temperature. It also has an extremely low specific gravity so that it actually makes such compacts lighter than they would be if they contained other easily-ignited materials like zirconium. Lithium is also a very soft material so that when pressurized in a compact it can flow a little and help anchor in place adjacent particles of other materials. Powdered sodium, powdered potassium and powdered rubidium behave very much like powdered lithium and are less expensive.

Powdered boron is known to have an extremely large thermal output per unit bulk, and is accordingly also a very desirable ingredient of a pyrophoric compact. In order to ignite the boron, a compact can contain by weight at least about 10 to 20% of pyrophoric iron powder. When powdered lithium or other alkali metal is mixed with pyrophoric iron, it reduces the total energy output per unit bulk, and so is best used in compacts that contain powdered boron as well as pyrophoric powder. A uniform mixture of all three ingredients should have at least about 10 to 20% pyrophoric powder, about 0.2 to 10% alkali metal powder, and the balance powdered boron or other high output powder such as zirconium or titanium.

In some cases better results are obtained by having the compact of non-uniform composition. Thus a 3-centimeter diameter cylindrical disc 1 millimeter thick can have at its axial center about a ½ to 1-centimeter diameter width of pyrophoric iron powder, surrounded by a 3-millimeter ring of powdered lithium, the balance being powdered boron. The pyrophoric action will then ignite the lithium and the burning lithium then ignites the boron. The stratification can have other orientations and dimensions, and need not be sharp. Boron can take the place of the lithium in which event it is preferred to increase the size of the pyrophoric circle to a full centimeter or slightly more or to use pyrophoric nickel powder in place of the pyrophoric iron powder.

The foregoing compacts can be prepared with or without binder. When powdered alkali metal is present in a concentration as low as ¼% by weight, in a compact, the retaining metal, foam or other mechanical support is not needed.

Obviously many modifications and variations of the present invention are possible in light of the above teachings. It is therefore to be understood that within the scope of the appended claims the invention may be practiced otherwise than as specifically described.

What is claimed:

1. A crushable open-celled metal skeleton in which the wall thickness of the metal is not over about 3 mils, and the open cells contain pyrophoric powder.

2. The combination of claim 1 in which the metal skeleton is a metal foam.

3. The combination of claim 1 in which the metal skeleton is a honeycomb.

4. The combination of claim 1 in which the metal skeleton is an expanded-twisted metal foil.

5. The combination of claim 1 in which the metal is combustible and the pyrophoric powder is sufficient to cause the metal to be raised to its combustion temperature by the pyrophoric reaction of the powder.

6. A coherent disc produced by crushing the combination of claim 1.

7. The combination of claim 6 in which the disc is less than 1 millimeter thick.

* * * * *